US005916030A

United States Patent [19]

Warner

[11] Patent Number: 5,916,030

[45] Date of Patent: Jun. 29, 1999

[54] CIRCULATING WATER SOUND BOX

[76] Inventor: Gregory K. Warner, S12 W26316 Chancery La., Waukesha, Wis. 53188

[21] Appl. No.: 09/046,879

[22] Filed: Mar. 24, 1998

[51] Int. Cl.[6] ..... A63J 5/04

[52] U.S. Cl. ..... 472/65; 472/64; 428/13

[58] Field of Search ..... 472/64, 65, 67, 472/128, 137; 206/314; 428/13; 40/406, 407

[56] References Cited

U.S. PATENT DOCUMENTS

| | | | |
|---|---|---|---|
| 3,613,264 | 10/1971 | Vitka et al. | 40/406 |
| 4,240,218 | 12/1980 | Kotzin | 40/407 |
| 5,143,107 | 9/1992 | Kelley | 472/65 X |
| 5,234,728 | 8/1993 | Chiang | 428/13 |
| 5,367,805 | 11/1994 | Bates | 40/406 |
| 5,637,361 | 6/1997 | Scheurich | 428/13 |
| 5,794,318 | 8/1998 | Parker et al. | 27/1 |

*Primary Examiner*—Kien T. Nguyen
*Attorney, Agent, or Firm*—Robert R. Kooiman, Agent

[57] ABSTRACT

A circulating water system is contained in a portable box. The water system includes a tray which carries the water from an overflow chamber and breaks up the water flow before dropping it onto a reservoir surface. Water dropping onto the reservoir surface creates sounds which are carried primarily through openings provided in the box. The sounds are transmitted to the immediate surroundings and are analogous to sounds emanating from naturally occurring water streams. Various trays are described which provide different sound intensities and tones.

8 Claims, 6 Drawing Sheets

CIRCULATING WATER SOUND BOX

BACKGROUND OF THE INVENTION

1. Field of the Invention

The present invention relates to apparatus for generating sounds which simulate natural sounds of flowing water streams through use of a circulatory water system.

2. Description of the Prior Art

Circulating water fountains which are designed to provide a pleasing appearance as well as sounds of flowing water are well known and some have been designed as portable units suitable for use in the home or office. Different designs of flow impediments such as stones and terraces have evolved to create cascading or gurgling sounds by the moving water.

SUMMARY OF THE INVENTION

The present invention relates to a circulatory water system incorporated within an acoustic box that contains a flowing waterway which includes selectable flow disturbing features to create random sounds similar to those from a variety of naturally flowing streams. Rivers, rivulets, brooks and creeks having water cascades or streams over rocks and other obstacles generate a variety of sounds which may be pleasing and relaxing to the listener. The present invention closely simulates these naturally occurring sounds through a closed loop water circulation system having a waterfall in an acoustic chamber. Different types and intensity of natural stream flows are reproduced through a variable output circulatory pump, selectable flow disturbing or modulating trays and a water drop distance dependent on reservoir level. A tray is inserted in position to receive and carry water falling from an overflow chamber and flow disruptive and gurgling sounds occur as the water drops from the tray into a partially filled water reservoir.

A wooden box contains all components of the system and acts as an acoustic chamber for delivering realistic sounds of impeded water streams. These sounds can be very effective for a listener to relieve stress or to provide pleasant relaxation. The different trays provide a variety of tones and the frequency and intensity of the sounds can be additionally varied through the variable output circulatory pump and the water drop distance.

DETAILED DESCRIPTION OF THE PREFERRED EMBODIMENTS

Figure 1:
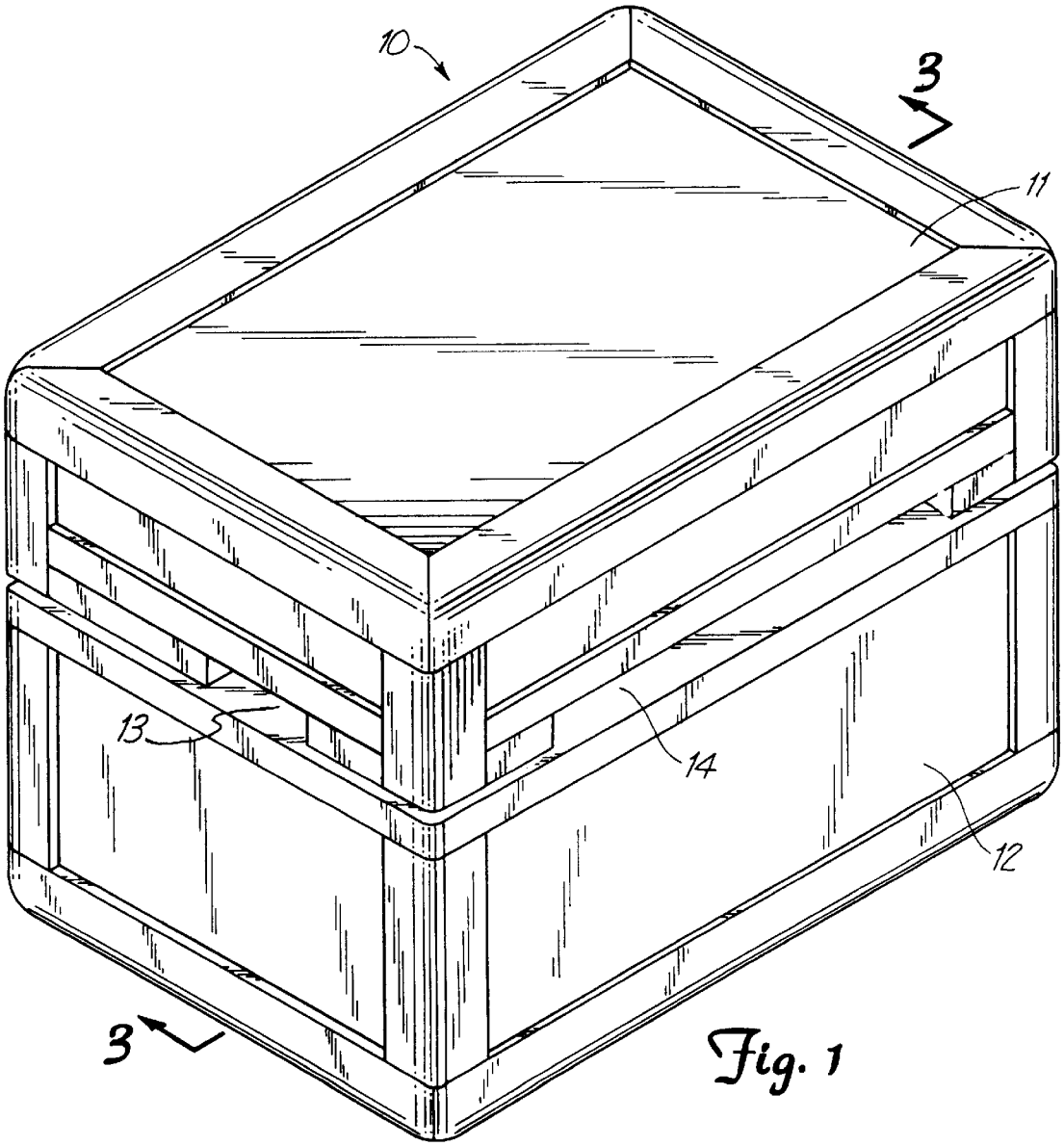
FIG. 1 is a top front perspective view of a typical circulating water box made according to the present invention.

In FIG. 1, a box indicated generally at 10 includes a top section 11 and bottom section 12 that may be hinged together for convenient access to the interior. Openings 13 and 14 of selected area are provided to transmit sound from inside the box to the exterior surroundings. An additional open area is provided around the top perimeter of the box bottom through proper mounting of the hinges 14 and 15 together with spacers 16 and 17 as shown in FIG. 2.

Figure 2:
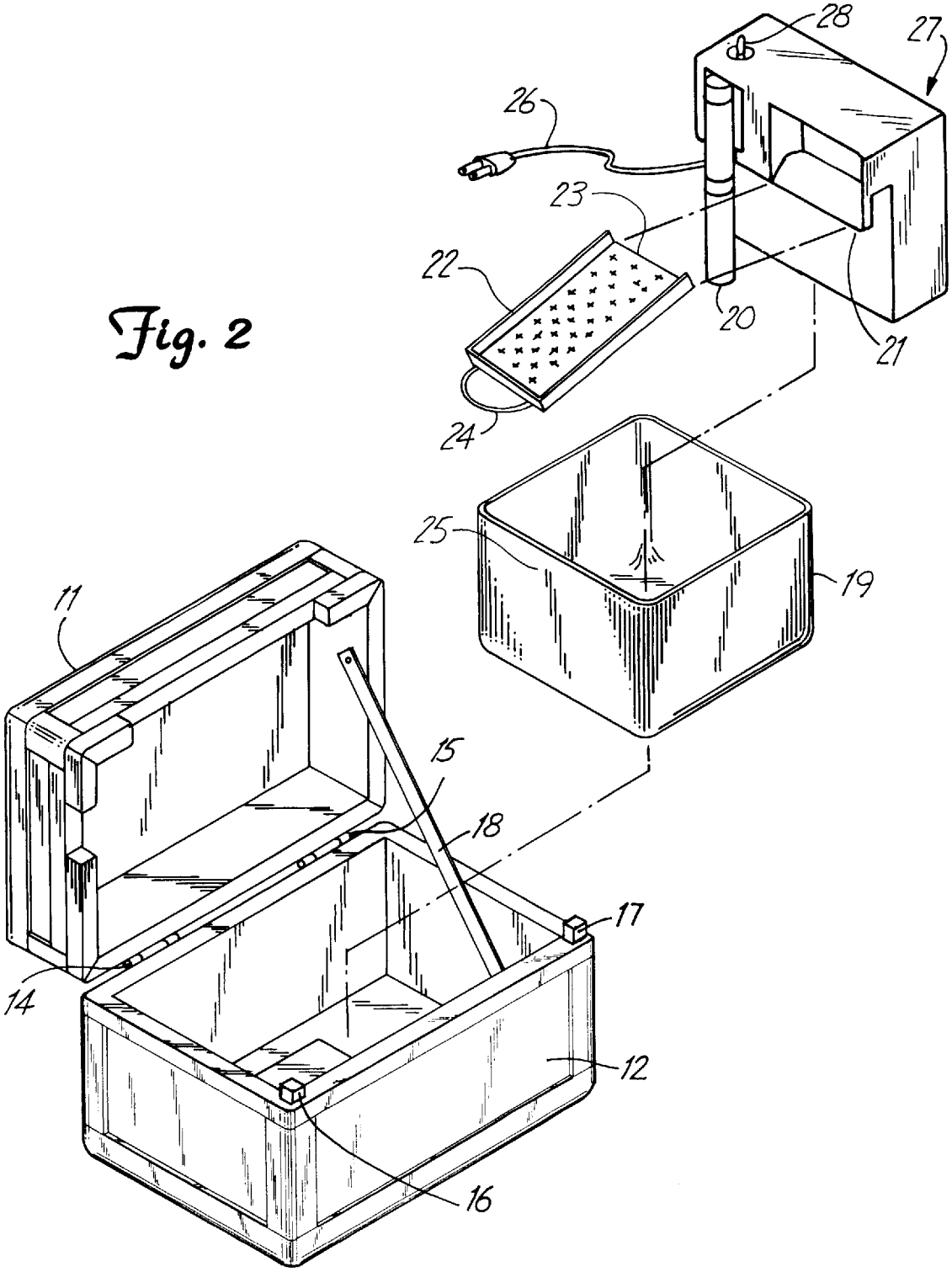
FIG. 2 is an exploded view of the design of FIG. 1 showing the design with the box opened and contents displayed.

In FIG. 2, the box 10 is shown opened with the contents removed in an exploded view for convenience in illustrating. A flexible strap 18 is employed to hold the top 11 in a convenient position for adjusting or servicing the box contents. A water reservoir 19 is positioned in the box bottom 12 with the pump inlet 20 and pump overflow ledge 21 overhanging one end of reservoir 19. A suitable reservoir is a polycarbonate container made by Cambro Manufacturing, Huntington Beach, Calif. This material contributes to the sound quality of the box when in operation. Tray 22 has one end 23 engaging the edge of ledge 21 to capture the overflow water and a bail 24 at the other end rests upon upper edge 25 of reservoir 19. The tray is supported at edge 25 such that the overflow proceeds at a slight upward incline along the tray surface. Spacers can be provided under reservoir 19 to raise edge 25 to a height above the overflow ledge 21. The upward incline encourages a uniform distribution of water on the tray surface. Bail 24 is semi-firmly attached to tray 22 so the incline can be selected by positioning of the bail. An electrical cord 26 connects to a pump situated cooperatively with overflow chamber 27. The pump volumetric flow is adjustable through movement of the control lever 28 situated in an accessible position at the upper end of chamber 27. A suitable combination chamber and pump is an AquaClear® 150 made in Italy and distributed by the Rolf C. Hagen Corporation, 50 Hampden Road, Mansfield, Me.

Figure 3:
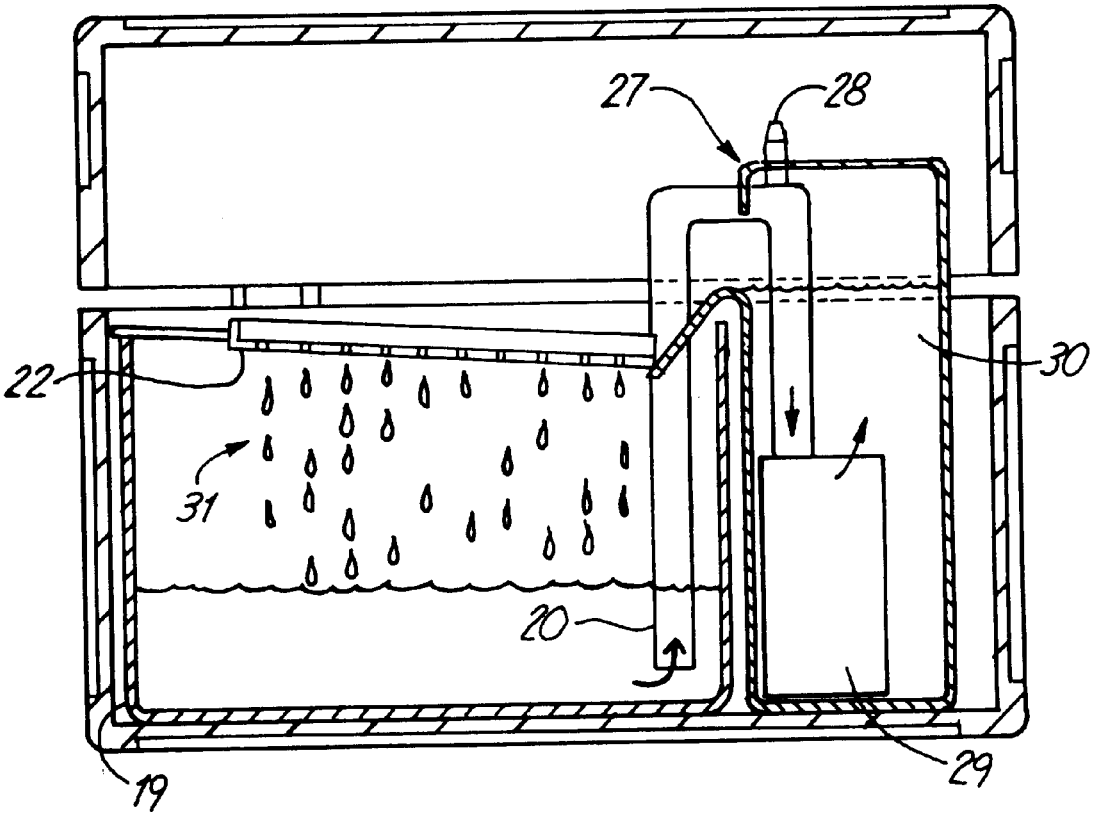
FIG. 3 is a sectional schematic view of the box of FIG. 1 illustrating the operation of the water box according to one embodiment of the invention.

Referring to FIGS. 2 and 3, when the pump is running, water is drawn upward through intake tube 20 to the pump shown schematically at 29 where it is discharged into overflow chamber 30. The water then flows over the overflow ledge 21 onto tray 22. Tray 22 is positioned above the water level in reservoir 19 and has openings provided to allow the water flow to be broken up before falling onto the water surface in reservoir 19. Flow circulation is continuous so long as the pump is powered and there is water in the reservoir. Impingement of the dripping water columns shown schematically at 31 on the reservoir surface creates sounds similar to that from naturally occurring streams or brooks where water flow is broken up by various obstacles such as rocks, abrupt changes in elevation and turns in the stream path.

The specific sounds created are completely random in sequence and intensity and tone can be controlled within limits through the amount of water in the system which affects the drop distance between tray 22 and the reservoir surface, the volumetric flow rate of the pump which can be adjusted by movement of lever 28 and by design of tray 22. Some sound is passed through the box walls but openings 13 and 14 together with the continuous opening provided by hinges 14 and 15 and spacers 16 and 17 provide the strongest acoustic path. An opening area of about one sixth to one third of the area of the top of the box has been found to be satisfactory. The box can be hinged along the long side as illustrated or along the short side (not shown). I have found that an opening area of about one fourth the top area is preferred for a box hinged on the short side and an opening area of about one fifth is preferred for the illustrated box configuration. A box measuring 8"×12"×9" high utilizing the AquaClear® 150 pump assembly referred to above and an initial charge of two liters of water has been found to be very satisfactory for providing water sounds to a typical room or office enclosure of 100 to 400 square feet in area. The box may be constructed of various materials but I have found ½" plywood to be suitable for the side and top panels. The bottom may also be of ½" plywood or varnished pressed wood. I employ moldings of ¼" pine at all corners to provide rigidity. This design also lends itself to specific artistic expressions on the outward facing of the panels through painted or burned designs on those panels. Alternatively, any of the outward facing surfaces can be used to mount a photograph under a glass or plastic sheet. The interior of the box is sealed against moisture penetration through the following process. The wood panel material is initially painted with a black latex gloss enamel and then covered with a polyurethane coating. Sections are then cut and the box is assembled using construction adhesive between surfaces and at all interior joints. The inside is then given a coating of marine varnish and a top coat of Geocel® Watershield brushable elastomeric sealant. One or more holes can be provided through the bottom of the box to provide free air circulation through the box.

Figure 4A:
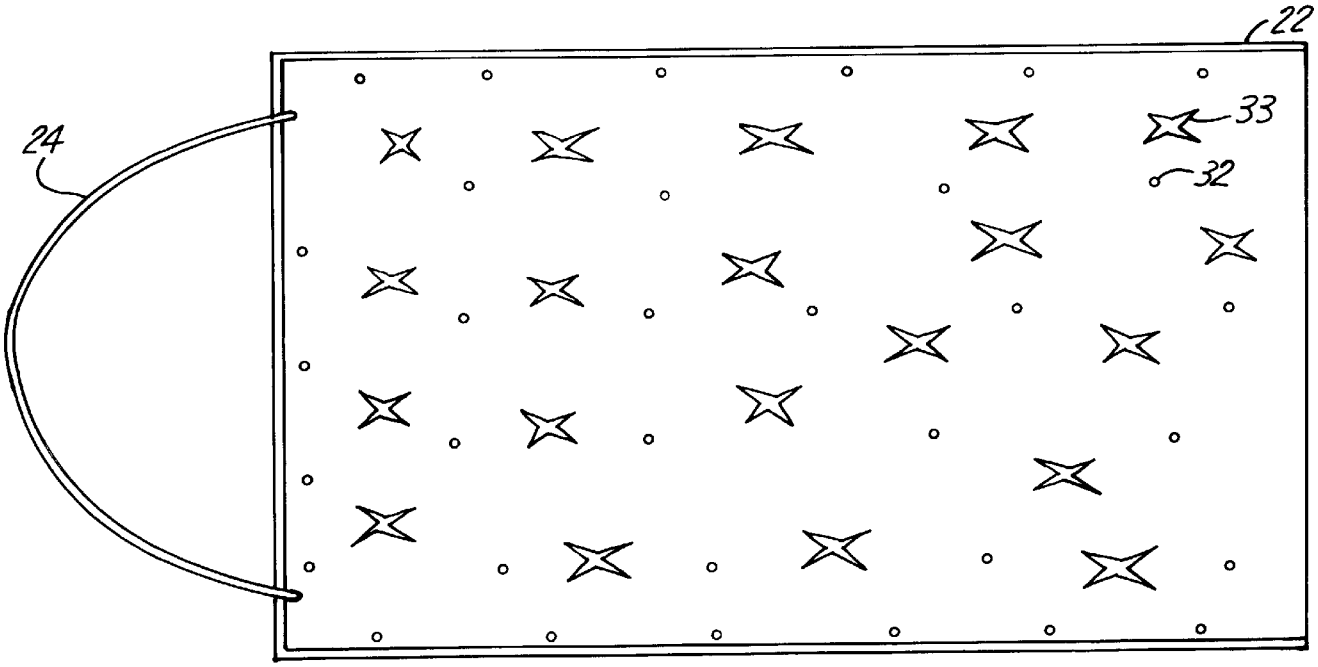
FIGS. 4A and 4B are plan and sectional views, respectively, showing the tray illustrated in FIG. 3.
Figure 4B:
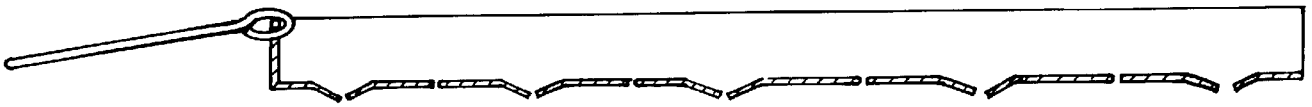
Figure 5A:
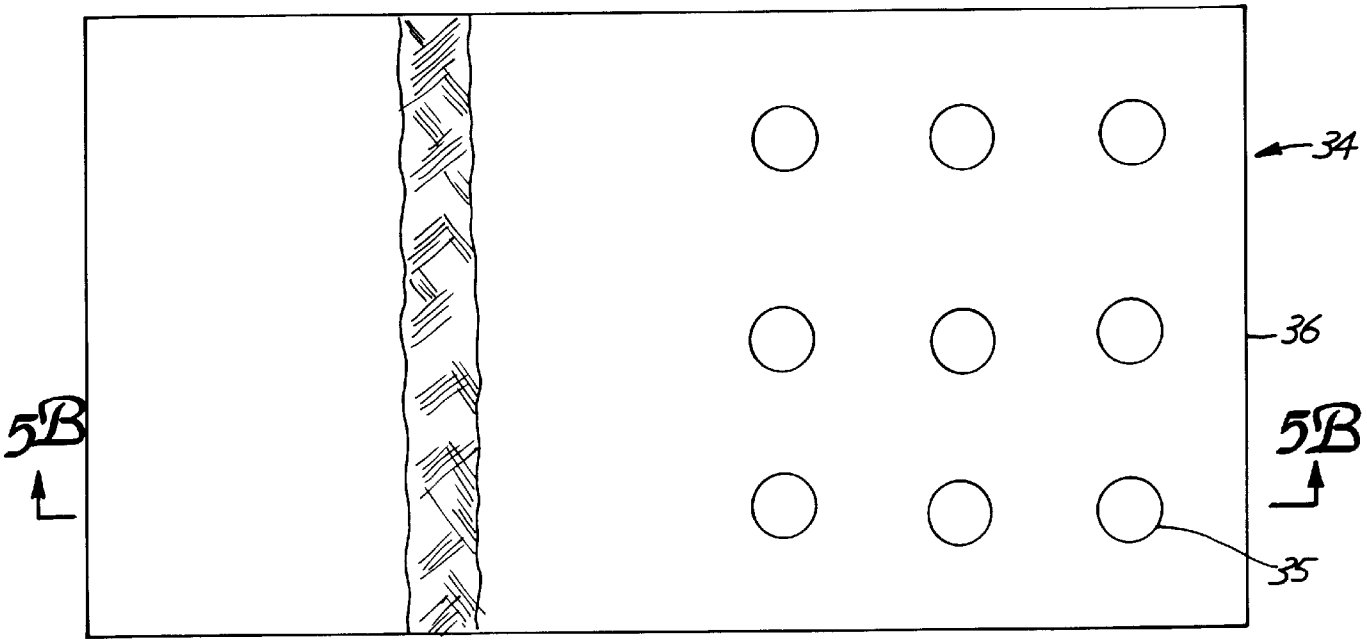
FIGS. 5A and 5B are plan and sectional views, respectively, of a second embodiment of the invention.
Figure 5B:
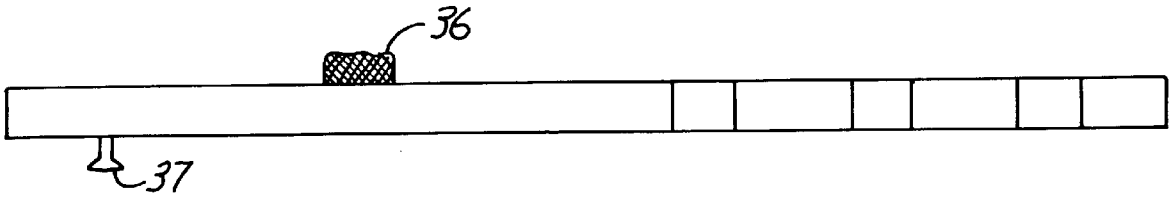
Figure 6:
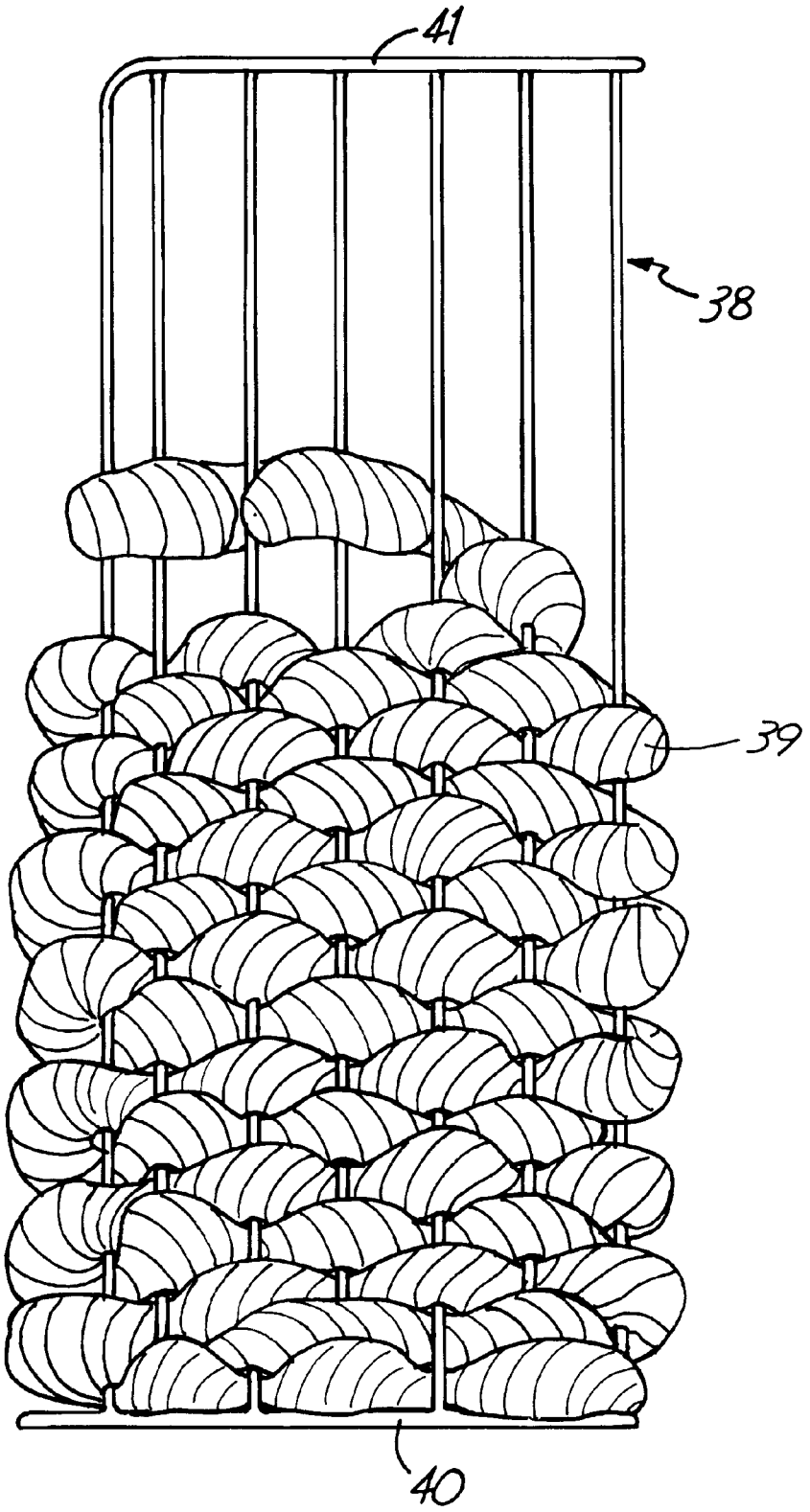
FIG. 6 is a plan view having limited perspective of a third embodiment of the invention.

An important feature of this invention is the adjustability in sound afforded through different tray designs shown in FIGS. 4, 5 and 6. The specific tray illustrated as 22 in FIGS. 2 and 3 is shown in more detail in FIGS. 4A and 4B. Referring to FIGS. 4A and 4B it may be seen that there are small circular holes 33 and larger star shaped apertures 33 in the tray surface. The tray may be formed from 23 gauge galvanized metal, stainless steel or aluminum and has containment walls along three sides as shown. The star shaped holes are conveniently made by drilling and then puncturing on a soft surface with a sharp chisel so that the apertures are funnel shaped. A random sizing of the openings helps to provide pleasant sounds. The small holes may be 1/16" diameter and the apertures are made with 3/32" holes and a 1/4" chisel. Thirty three apertures and forty holes in a 3"×5½" tray gives a good result in the embodiment described.

An alternate tray 34 is shown in FIGS. 5A and 5B. Tray 34 has a small number of larger holes 35 and a dam 36 but it has now containment side walls. A screw 37 is positioned to fit against the reservoir upper edge 25 to urge the forward end 36 of tray 34 onto the overflow ledge 21. Overflow water flows through the holes 25 and also over the sides of tray 34. In the embodiment shown, tray 34 is made of 3/16" wood and the nine holes are 3/8" diameter. Dam 36 is a piece of 1/4" braided nylon rope fastened to tray 34 by water resistant glue and staple (not shown).

A third alternate is shown in FIG. 6 where the tray 22 is comprised of a rack 38 and rope 39. Rack 38 tapers slightly in width from leading edge 40 to trailing edge 41. In the embodiment illustrated, rack 38 is made of stainless wires approximately 1/16" diameter. The leading edge wire 40 is 3" long and the trailing edge wire 41 is 2½" long. The rack length is 6". Rope 39 is a 5/16" braided manila approximately five feet in length which is interlaced over and under adjacent wires over about ¾ the length of rack 38 and secured at each end with knots. In use, leading edge 40 is positioned on overflow ledge 21 and trailing edge 41 fits over reservoir upper edge 25. The water flow is broken up in a complex manner by the rope and tightness of the weave is a significant and adjustable variable.

A variety of sound intensities and tones are available through control of volumetric flow, drop distances of the water and, very significantly, through choice of trays which break up or modulate the water flow in different ways, thereby providing different sound effects. The metal tray illustrated in FIG. 4 provides energetic, action related sounds which can be mentally uplifting to a tired or depressed state of mind. In contrast, the rope tray illustrated in FIG. 6 provides much more of a soothing or relaxing type of sound suitable for alleviating a state of high stress. The effect is akin to that of running water in a natural setting and as indicated the nature of the sound may be altered by slight repositioning or shifting of the rows of woven rope. The wood tray illustrated in FIG. 5 provides sound effects somewhat between that of the metal and rope trays and may be likened to sounds emanating from a spring brook.

Although the present invention has been described with reference to preferred embodiments, workers skilled in the art will recognize that changes may be made in form and detail without departing from the spirit and scope of the invention.

What is claimed is:

1. A sound generating apparatus comprising:

an enclosure having a sound transmission chamber opening to the outside and a door for access to the interior;

an electrically driven water pump within the enclosure having intake and exhaust ports;

water containment means coupled to the intake and exhaust ports to provide a flow circulation path; and flow disturbing means between the exhaust and intake ports to provide sound;

whereby the sound of disturbed water flow is created and transmitted through the opening when the pump is activated.

2. The apparatus of claim 1 wherein the water containment means includes a water reservoir, wherein a water fall drops into the water reservoir in the flow circulation path whereby the falling water produces sound through impact with the reservoir water.

3. The apparatus of claim 2 further comprising a flow modulation device having means to break up the flow above the reservoir to provide sounds through multiple columns of falling water.

4. The apparatus of claim 3 wherein the flow modulation device comprises a tray having multiple holes therethrough and means to removably mount the tray in an approximate horizontal position between the water fall and reservoir water.

5. The apparatus of claim 3 wherein the flow modulation device comprises an assembly of spaced side by side longitudinal wires connected to cross wires at respective ends to secure the spaced longitudinal wires; a rope interlaced over and under adjacent longitudinal wires in parallel rows so that adjacent rows of rope on intermediate longitudinal wires alternate between over and under positioning; and means to removably mount the assembly in an approximate horizontal position between the water fall and reservoir water.

6. The apparatus of claim 2 wherein the reservoir is made of a polycarbonate material.

7. The apparatus of claim 1 wherein the enclosure comprises a wood box having an opening area of about one-sixth to one-third the area of the box.

8. A water flow disturbance apparatus comprising:

an assembly of spaced side by side longitudinal wires connected to cross wires at respective ends to fasten the longitudinal wires;

a rope continuously interlaced over and under adjacent longitudinal wires so that adjacent rows of rope on intermediate longitudinal wires alternate between over and under positioning;

means to support the assembly so that the cross wires are substantially horizontal;

means to provide a stream of water to the upper side of the apparatus; and means to space the apparatus in the stream above a pool of water to provide a gurgling water sound.

* * * * *